United States Patent [19]

Gibbs

[11] Patent Number: 4,805,303

[45] Date of Patent: Feb. 21, 1989

[54] MULTI-BLADE FOLDING KNIFE WITH LOCK OPEN FEATURE

[76] Inventor: Philip W. Gibbs, South St., Camillus, N.Y. 13031

[21] Appl. No.: 166,407

[22] Filed: Mar. 10, 1988

[51] Int. Cl.[4] ..... B26B 3/06

[52] U.S. Cl. ..... 30/161; 30/155; 7/118

[58] Field of Search ..... 30/152, 155, 158, 159, 30/160, 161, 164, 118

[56] References Cited

U.S. PATENT DOCUMENTS

| | | | |
|---|---|---|---|
| 645,563 | 3/1900 | Heath | 30/161 |
| 1,359,760 | 11/1920 | Smith | 30/155 X |
| 4,302,877 | 12/1981 | Hart et al. | 30/161 |
| 4,563,813 | 1/1986 | Fortenberry | 30/161 |
| 4,669,188 | 6/1987 | Evrell | 30/161 |

*Primary Examiner*—Frank T. Yost

*Assistant Examiner*—Michael D. Folkerts

*Attorney, Agent, or Firm*—Charles S. McGuire

[57] ABSTRACT

A knife having a plurality of blades or other implements foldable about a common pivot axis at one end of the handle. A separate lock lever is associated with each blade or implement and has an end portion engaging a notch in the blade adjacent the pivot point to prevent movement of the blade away from the open position until the lock is manually released. The lock levers are pivotally mounted at an intermediate position and urged toward engagement of the one end portion with the blade notch by respective beam springs contacting the lock levers on the opposite sides of the pivotal mountings. The locks are released by pressing upon portions of the lock levers arranged in transverse grooves which are longitudinally offset along the back of the knife at the end opposite the end at which the blades are pivotally mounted.

12 Claims, 2 Drawing Sheets

MULTI-BLADE FOLDING KNIFE WITH LOCK OPEN FEATURE

BACKGROUND OF THE INVENTION

This invention relates to folding knives, and more particularly to multi-blade folding knives having locking means automatically movable to prevent movement of each blade away from its fully open position until the lock is manually released.

Folding knives, having one or more blades or other implements pivotally movable about a transverse pin between open and closed positions, have been provided with locking means for securely holding the blade in one or both positions. The lock must be released, of course, by manual movement of some element on the knife in order to move the blade from the position in which it is locked to the other position. Means for locking the blade in the fully open position are provided for safety purposes to reduce the chances of injury to the user by unintended movement of the blade toward the closed position while in use.

A single blade folding knife with lock-open feature is disclosed, for example, in U.S. Pat. No. 4,240,201, and other locking knives developed over the past hundred-odd years are shown in other art cited or discussed therein. In general, such knives include a push button at some position on the handle to unlock the mechanism holding the blade in the fully open position; since the button is normally fully exposed, there remains the possibility of inadvertent unlocking of the blade and consequent undesired movement toward the closed position.

Other knives have been proposed with mechanism for individually locking each of a plurality of blades in the open position with release means in the rear longitudinal surface of the handle. In such knives, a portion of the locking member which engages a notch in the blade tang, or a spring member in contact therewith, is accessible in a groove extending transversely across the back of the handle and may be manually pressed to release the lock. In some multi-blade knives two blades are pivoted at opposite ends of the handle, in which case the grooves for the release mechanisms of the blades are also positioned at longitudinally spaced positions along the handle. In other knives the blades are pivotally movable about a single pin at one end of the handle with the release mechanism for both blades positioned side-by-side in a single groove extending transversely across the back of the handle. This creates a problem due to the close, side-by-side positioning of the releasing members making individual manipulation thereof difficult.

It is a principal object of the present invention to provide a multi-blade folding knife wherein all blades are pivoted on a single pin and having blade lock-open members which are quickly and easily releasable, yet thoroughly safe.

Another object is to provide a folding knife including a pair of blades individually pivotable about a pin at one end of the handle with locking members for each blade and release means having manually engageable portions accessible in grooves which are both laterally and longitudinally spaced along the back of the handle.

A further object is to provide a multi-blade folding knife with lock-open feature having a pair of uniquely configured and arranged beam springs for releasably holding locking members in engagement with the blades to lock them in the fully open position until manually released.

Other objects will in part be obvious and will in part appear hereinafter.

SUMMARY OF THE INVENTION

The knife of the present invention includes a pair of folding blades or other implements which, of course, need not be cutting implements in the usual sense, but will be termed "blades" for convenience. It will be understood that as used herein the term encompasses all implements which may be pivotally mounted on a handle for movement with respect thereto between folded and erected positions. In any case, the blades in the knife of the present invention are both mounted for movement about a single pivot pin passing transversely through handle members adjacent one end thereof.

A squared notch is formed in the tang of each blade adjacent the opening through which the pivot pin passes. A pair of lock levers each include a squared end portion shaped and positioned for engagement with the notch in one of the blades when the latter is in its erected or open position, preventing movement of the blade about its pivotal mounting until the lock lever end portion is removed from the notch. The levers are mounted for limited pivotal movement about an axis intermediate the ends and parallel to the pivotal axis of the blades.

Both lock levers are urged toward movement in a direction engaging the squared end thereof with the blade notch by an associated beam spring. The two springs are anchored at one end by a pair of spaced pins passing through both springs, and bear at their opposite ends against the lock levers. The knife handle is formed of a pair of cover pieces and linings, normally of plastic and metal, respectively, on opposite sides of the knife. Another metal piece, commonly termed a center scale, is positioned between and parallel to the longitudinally aligned pair of lock levers and beam springs.

Each of the handle cover pieces and linings, as well as the center scale, is provided with a pair of curved grooves or scallops in one edge. The grooves in the several elements are laterally aligned when the knife is fully assembled and are longitudinally spaced but preferably closely adjacent at the end of the knife opposite that at which the blades are pivotally mounted. One of the two lock levers and the opposite one of the two beam springs each have a single groove aligned with respective ones of the two grooves in the other members.

The lock levers may be released from locking engagement with the respective blades by manually pressing on the portion of the associated lock lever which extends into the groove on one side of the knife, thereby pivoting the lock lever against the bias of the associated beam spring. Individual manipulation of the laterally spaced lock levers is facilitated by positioning the manually engageable portions thereof in grooves which are longitudinally spaced at one end of the knife handle.

DETAILED DESCRIPTION

Figure 1:
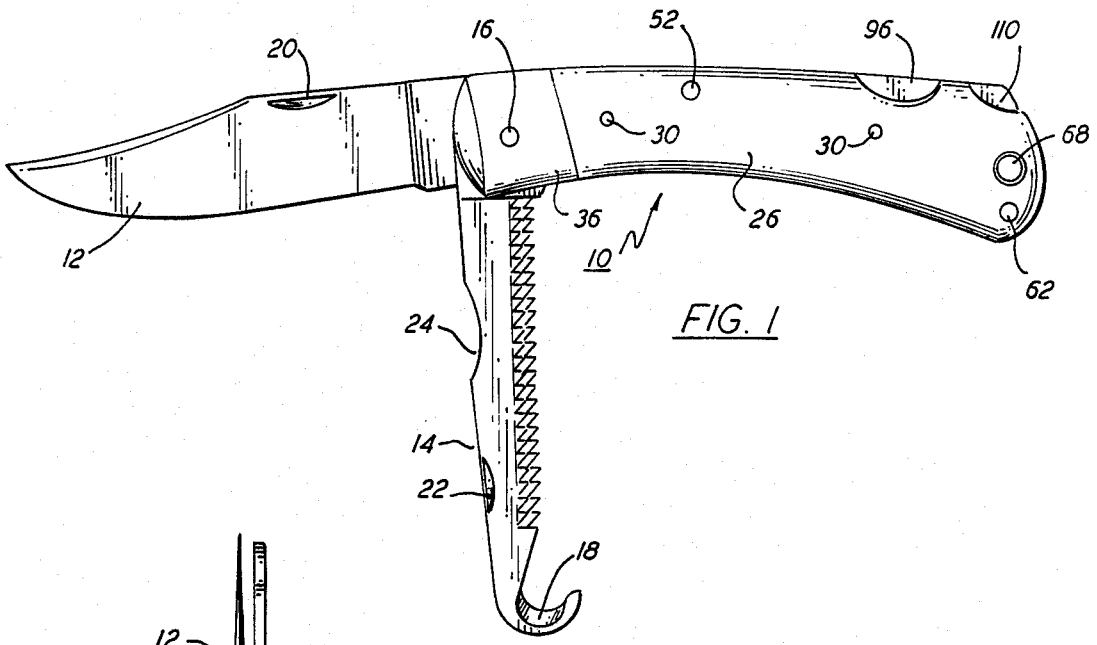
FIG. 1 is a side elevational view of the knife of the invention in a preferred embodiment, shown with one blade fully open and one partly open.
Figure 2:
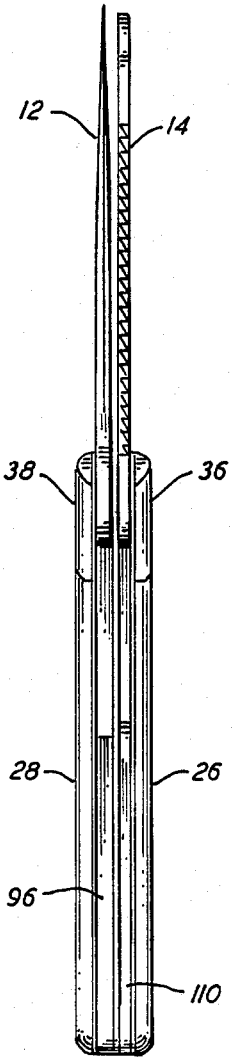
FIG. 2 is a front elevational view of the knife of FIG. 1, with both blades fully open.
Figure 3:
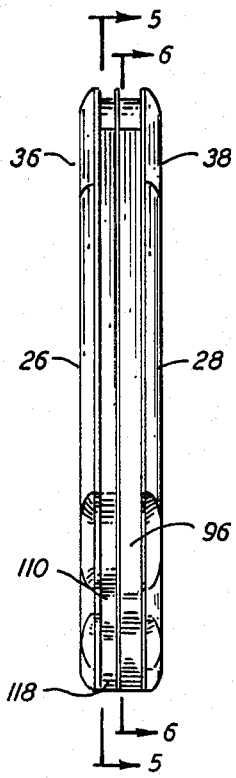
FIG. 3 is a rear elevational view.

Referring now to the drawings, the knife of the invention comprises a handle portion, denoted generally by reference numeral 10, having a number of components separately described hereinafter, and a pair of blades 12 and 14. The blades are both mounted for pivotal movement between folded and open positions with respect to handle 10 about pivot pin 16. Blade 12 is shown with a standard cutting edge and blade 14 has a saw-toothed edge with hook 18 at the end opposite the pivotal mounting. Blades 12 and 14 each include a notch 20 and 22, respectively, for engaging the blade, normally with a thumbnail, to move the blades away from the folded position in the usual manner. Groove 24 is provided in the rear edge of blade 14 to allow access to notch 20 in blade 12 while blade 14 is in its folded position.

Figure 4:
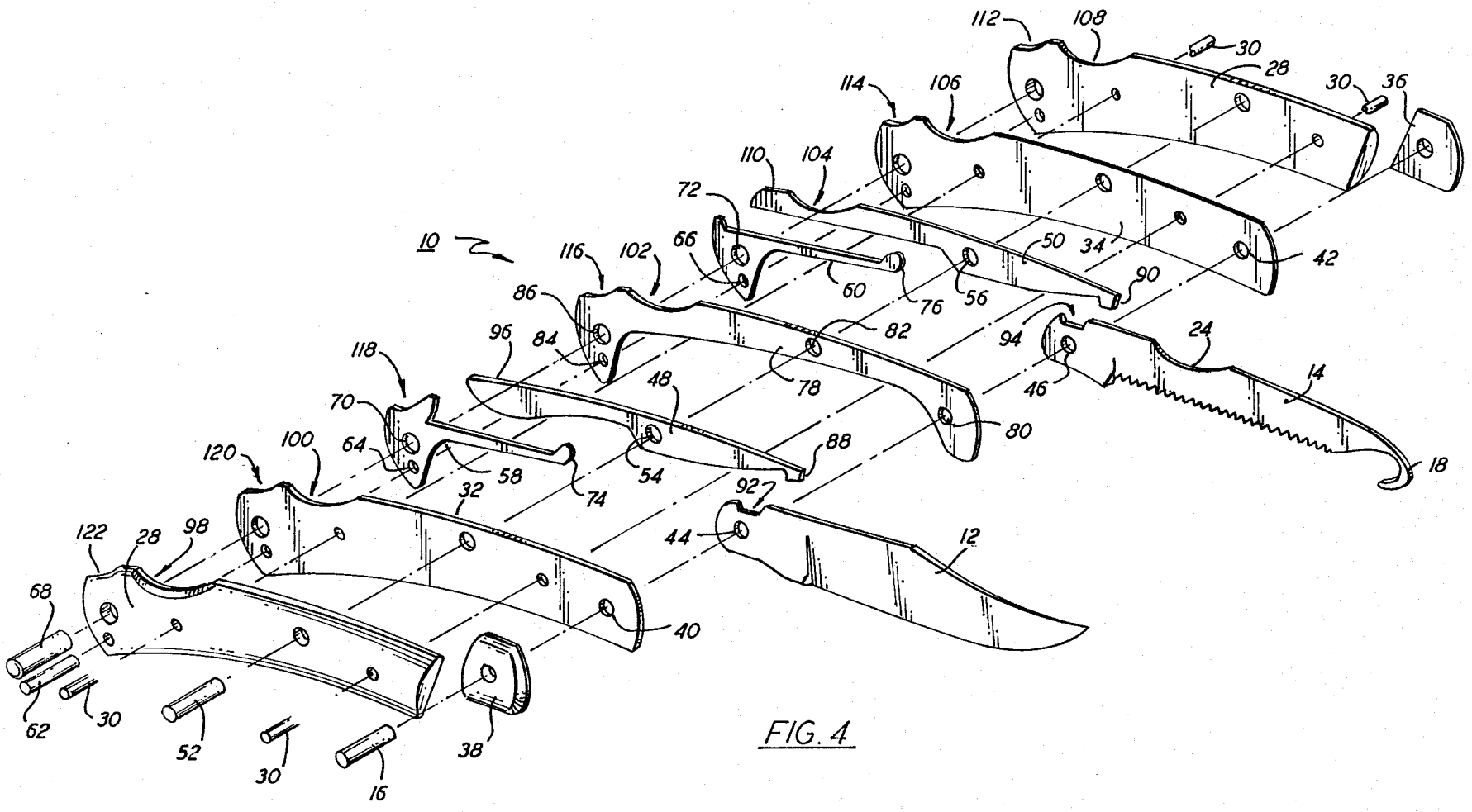
FIG. 4 is an exploded perspective view.

Handle 10 includes outer cover pieces 26 and 28, preferably of Delrin or other suitable plastic, attached by pins 30 to linings 32 and 34, respectively, preferably of brass. Handle 10 further includes bolsters 36 and 38, also mounted upon linings 32 and 34, respectively, by pivot pin 16 which passes entirely through handle 10, in complementary relation to cover pieces 26 and 28 so that the cover pieces and bolsters completely cover the linings. Pivot pin 16 extends through openings 40 and 42 in linings 32 and 34, respectively, and through openings 44 and 46 in the tang portions of blades 12 and 14, respectively (FIG. 4).

A pair of lock levers 48 and 50 are mounted parallel to one another in handle 10 for limited pivotal movement about middle pin 52 which passes through openings 54 and 56 in levers 48 and 50, respectively. Beam springs 58 and 60 are also mounted in handle 10 by butt pin 62, which passes through openings 64 and 66 in end portions of springs 58 and 60, respectively, and hollow tube 68, which passes through openings 70 and 72 in the same end portions. End portions 74 and 76 of beam springs 58 and 60, respectively, are positioned to bear against portions of lock levers 48 and 50, respectively, on one side of the pivotal mountings thereof, in the fully assembled condition of handle 10.

Also included in handle 10 is center scale 78, an appropriately configured brass strip which separates the tang portions of blades 12 and 14 in the usual manner of folding knife construction. Center scale 78 also separates lock lever 48 and associated beam spring 58 on one side from lock lever 50 and beam spring 60 on the other side. Pivot pin 16, middle pin 52, butt pin 62 and tube 68 pass through openings 80, 82, 84 and 86, respectively, in center scale 78.

Lock levers 48 and 50 are formed with squared end portions 88 and 89, respectively. Squared notches 92 and 94 are formed in the tang portions of blades 12 and 14, respectively, adjacent pivot pin openings 44 and 46. Lock levers 48 and 50 are urged toward rotation about their respective pivotal mountings by beam springs 58 and 60 in a direction moving end portions 88 and 90 into engagement with the tang portions of blades 12 and 14, respectively. Thus, the lock levers serve the function of the usual back springs provided in folding knives to act cooperatively with the blade tangs, resiliently urging the blades into both the fully closed or folded and fully open positions.

Figure 5:
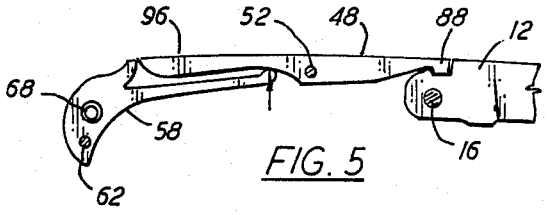
FIGS. 5 and 5*a* are fragmentary, elevational views, in section on the line 5—5 of FIG. 3, showing certain elements in first and second positions of movement.
Figure 5A:
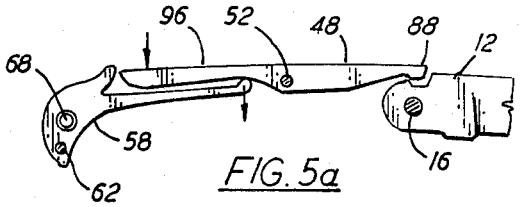

When blade 12 is moved to its fully open position, squared portion 88 of lock lever 48 enters notch 92, thereby preventing further movement of blade 12 in either direction until end portion 88 is removed from notch 92. This may be accomplished by manually pressing on portion 96 of lock lever 48, forcing it to rotate a short distance against the biasing force of beam spring 58. It will be noted that portion 96 of lock lever 48 is positioned in a groove extending across the back of handle 10 and formed by laterally aligned grooves 98 and 100 in cover pieces 26 and lining 32, respectively, on one side of lock lever 48, and grooves 102, 104, 106 and 108 in center scale 78, lock lever 50, lining 34 and cover piece 28, respectively, on the other side. Movement of lock lever 48 and its associated beam spring 58 between locking and unlocking positions is illustrated in FIGS. 5 and 5*a*, respectively.

Figure 6:
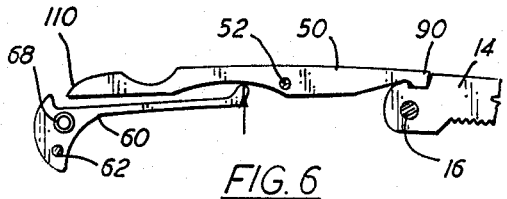
FIGS. 6 and 6*a* are fragmentary, elevational views, in section on the line 6—6 of FIG. 3, showing other elements in first and second positions.
Figure 6A:
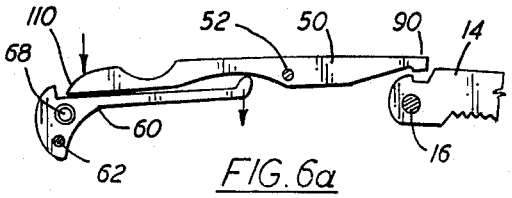

Blade 14 is locked in its fully open position by engagement of squared end portion 90 of lock lever 50 in notch 94. Unlocking is accomplished by manually pressing on portion 110 of lock lever 50 to produce rotation against the biasing force of spring 60. The elements are shown in the locking and unlocking positions in FIGS. 6 and 6*a*, respectively. Portion 110 of lock lever 50 is also arranged in a groove extending laterally across the back of handle 10. The continuous groove is formed by laterally aligned grooves 112 and 114 in cover piece 28 and lining 34, respectively, on one side of portion 110, and by grooves 116, 118, 120 and 122 in center scale 78, beam spring 58, lining 32 and cover piece 26 on the other side.

From the foregoing, it may be seen that the knife of the present invention provides an effective means for locking the individual blades, both of which are mounted for pivotal movement about a common axis at one end of the handle, in their fully open position. The locking means are automatically operable upon movement of the blades to their fully open position. The unlocking or release means are both safe and effective, permitting easy manual manipulation of portions of the individual locking members which are arranged in continuous grooves extending laterally across the rear of the handle in longitudinally offset positions at the end of the handle opposite that at which the blades are pivotally mounted. The continuous grooves are provided by laterally aligned grooves in the elements of the knife handle, including one of the lock levers and the spring associated with the opposite lock lever.

What is claimed is:

1. In a folding knife having a handle portion and at least two blades each having a tang portion pivotally mounted for movement about a common axis at one end of said handle for movement of said blades between closed and open positions, locking and release mechanism for releasably securing each of said blades in the fully open position, said mechanism comprising, in combination:

(a) a first lock lever mounted upon said handle for limited pivotal movement with respect thereto about a pivot axis parallel to said common axis, and having a first end portion configured for engagement in a notch in the tang portion of a first of said blades which is aligned with said first lock lever first end portion when said first blade is in its fully open position, wherein said first lock lever and said first blade are in substantially longitudinally aligned relation;

(b) a first beam spring mounted upon said handle, and having a first end portion anchored to said handle at the end thereof opposite said one end, and a second end contacting said first lock lever at a position on the opposite side of said pivot axis from said first lock lever first end portion and exerting a biasing force urging said first lock lever toward rotation in a direction moving said first lock lever first end portion into engagement with said notch in said first blade tang portion, said first spring second end being flexibly moveable against said biasing force by manual pressure exerted on a predetermined portion of said first lock lever;

(c) a second lock lever mounted upon said handle for limited pivotal movement with respect thereto about said pivot axis, and having a first end portion configured for engagement in a notch in the tang portion of a second of said blades which is aligned with said second lock lever first end portion when said second blade is in its fully open position, wherein said second lock lever and said second blade are in substantially longitudinally aligned relation;

(d) a second beam spring mounted upon said handle, and having a first end portion anchored to said handle at said opposite end thereof, and a second end contacting said second lock lever at a position on the opposite side of said pivot axis from said second lock lever first end portion and exerting a biasing force urging said second lock lever toward rotation in a direction moving said second lock lever first end portion into engagement with said second blade tang portion, said second spring second end being flexibly moveable against said biasing force by manual pressure exerted on a predetermined portion of said second lock lever; and (e) means longitudinally spaced along said handle at said opposite end thereof defining said predetermined portions of said first and second lock levers.

2. The invention according to claim 1 wherein said longitudinally spaced means comprise first and second grooves extending laterally across the back of said handle, said predetermined portions of said first and second lock levers being disposed in said first and second grooves, respectively.

3. The invention according to claim 2 wherein said predetermined portions of said lock levers are substantially at the respective ends of said lock levers opposite said first end portions thereof.

4. The invention according to claim 2 wherein said first groove extends through a portion of said second lock lever.

5. The invention according to claim 4 wherein said second groove extends through a portion of said first beam spring.

6. The invention according to claim 5 wherein said first end portions of said first and second lock levers, and said notches in said first and second blade tang portions are substantially square.

7. A folding knife comprising:

(a) first and second blades each having a tang portion with a notch therein;

(b) a handle portion including a pair of spaced linings each externally covered by a cover piece of substantially the same outline as said linings;

(c) a pivot pin extending through both of said blade tang portions to mount said first and second blades adjacent one end of said handle portion for individual, pivotal movement with respect thereto between open and closed positions;

(d) first and second, elongated lock levers mounted in parallel relation between said linings at intermediate positions between first and second end portions for individual, limited, pivotal movement between first and second positions, wherein said first end portion of said lock levers is respectively in and out of engagement with said notch in a respective one of said blade tang portions when said blades are in their open position;

(e) first and second beam springs each having an anchored end and a free end, and mounted in parallel relation to one another and in longitudinally aligned relation with said first and second lock levers, respectively;

(f) said free ends of said beam springs contacting said first and second lock levers, respectively, at positions thereon on the opposite side of the pivotal mountings of said lock levers from said first end portions urging said lock levers toward said first position, said lock levers being movable to said second position by manual pressure exerted on said second end portions; and (g) first and second grooves extending laterally across said handle portion at longitudinally spaced positions adjacent the end opposite said first end, said second end portions of said first and second lock levers being disposed in said first and second grooves, respectively, wherein they are accessible for individual exertion of said manual pressure.

8. The folding knife of claim 7 and further including a center scale mounted in said handle portion between said first lock lever, first beam spring and first blade tang portion on one side, and said second lock lever, second beam spring and second blade tang portion on the other side.

9. The folding knife of claim 8 wherein said pivot pin extends through both of said cover pieces, linings and blade tang portions, and said center scale.

10. The folding knife of claim 9 wherein each of said cover pieces comprises a metal part arranged at said one end of said handle portion and through which said pivot pin extends.

11. The folding knife of claim 8 wherein said first groove comprises laterally aligned grooves in both of said cover pieces and linings, said center scale and said second lock lever.

12. The folding knife of claim 11 wherein said second groove comprises laterally aligned grooves in both of said cover pieces and linings, said center scale and said first beam spring.

* * * * *